US005394229A

United States Patent [19]

Palmatier

[11] Patent Number: 5,394,229

[45] Date of Patent: Feb. 28, 1995

[54] RETARD FEED APPARATUS WITH NOISE SUPPRESSION DEVICE

[75] Inventor: Richard Palmatier, Springwater, N.Y.

[73] Assignee: Xerox Corporation, Stamford, Conn.

[21] Appl. No.: 83,225

[22] Filed: Jun. 29, 1993

[51] Int. Cl.[6] ..... G03G 15/00

[52] U.S. Cl. ..... 355/309; 271/3.1; 271/118

[58] Field of Search ..... 355/321, 317, 309, 308, 355/31; 271/96, 98, 121, 3.1, 8.1, 229, 182, 147, 117–118, 121, 126, 209

[56] References Cited

U.S. PATENT DOCUMENTS

| | | | |
|---|---|---|---|
| 4,541,711 | 9/1985 | Takahashi | 346/160 X |
| 4,660,963 | 4/1987 | Stemmle | 355/24 |
| 4,699,369 | 10/1987 | Zirilli | 271/94 |
| 4,901,117 | 2/1990 | Derrick | 355/309 |
| 5,004,218 | 4/1991 | Sardano et al. | 271/35 |
| 5,011,124 | 4/1991 | Sardano et al. | 271/35 |
| 5,033,731 | 7/1991 | Looney | 271/176 |
| 5,052,675 | 10/1991 | Shehata et al. | 271/98 |
| 5,083,766 | 1/1992 | Osawa | 271/121 |
| 5,255,599 | 10/1993 | Kobayashi et al. | 101/119 |
| 5,271,615 | 12/1993 | Kawauchi et al. | 271/121 |

*Primary Examiner*—A. T. Grimley
*Assistant Examiner*—T. A. Dang
*Attorney, Agent, or Firm*—Kevin R. Kepner

[57] ABSTRACT

A retard feeder system having a noise suppression device which feeds sheets from a stack of sheets to a sheet transport path. The device includes a sheet feeding friction device for engaging and moving sheets in a direction toward the path, a retard pad positioned adjacent said sheet feeding device to form a retard nip to permit selective feeding of individual sheets through the retard nip to the path, and a raised portion in the path for corrugating the sheet as portions of the sheet are engaged in the retard nip. The corrugation of the sheet helps to minimize the sheet flutter and vibration while it is within the retard nip by increasing the beam strength of the sheet and thereby decreases the audible noise created by the vibrating sheet.

12 Claims, 4 Drawing Sheets

RETARD FEED APPARATUS WITH NOISE SUPPRESSION DEVICE

This invention relates generally to a sheet feeding device, and more particularly concerns a retard sheet feeding apparatus having a noise suppression device therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. These machines typically employ sheet handling devices generally referred to in two categories, the first being document handlers, which are used to transport sheets of material bearing images including, for example, Mylar, vellum, paper and the like, and the second, copy sheet handlers, which transport sheets of similar material which, at least initially, generally are not image bearing. Both types of handlers are frequently employed with electrophotographic printing machines. That is, printers, duplicators and copiers commonly employ sheet handling devices to transport sheets to and from image imprinting stations (e.g., a transfer station in an electrophotographic printing machine) and image reproduction or imaging input station (e.g., an image input scanning station in electrophotographic printing machine). This invention relates to both types of sheet handling devices, generally, but is more particularly directed to application and use in copy sheet handlers which employ trays or bins for stacking sheets for selective feeding therefrom.

In electrophotographic printing machines requiring copy sheet handling, the copy sheet handling devices often include at least one tray or bin for holding and/or receiving copy sheets for transport to an image transfer station where an image developed from a latent on a photoconductive surface is transferred to the transported sheets. For the convenience of the user and to increase the utility and functionality of the overall machine, such copy sheet handling devices are often provided with multiple trays so that sheets of different material and/or sizes, as well as different uses can be utilized (e.g., a buffer tray for recirculating sheets for duplex imaging). In general, these multiple trays are arranged to feed copy sheets to a sheet transport for transport to the transfer station in which sheets may be stacked by the operator and/or by mechanical means (e.g., a buffer tray for recirculating sheets for duplex imaging).

Various apparatus and techniques have been developed and used to transport the sheets from the sheet trays in an effective and efficient manner. These devices include so-called retard feeders which can include generally a transport actuator, such as a friction roller or belt for engaging a surface of a particular sheet to move the sheet along a path and a pad or other retard surface proximate the transport actuator for engaging the surface of and retarding the transport of other sheets tending to move with the particular sheet. In these devices, there is, however, a problem associated with such transports in that often the transport of the sheets by the sheet actuator and the retard surface is accompanied by an audible noise. Thus, there exists a need to provide a retard feeding apparatus, which for increased convenience, utility and versatility of such retard feeding apparatus, exhibits both a reduced noise volume in the transport of sheets, as well as, fewer incidents of noise associated with the transport of sheets thereby.

The following disclosures may be relevant to various aspects of the present invention:

U.S. Pat. No. 4,901,117 Inventor: Derrick Issue Date: Feb. 13, 1990

U.S. Pat. No. 4,660,963 Patentee: Stemmle Issued: Apr. 28, 1987

U.S. Pat. No. 5,004,218 Patentee: Sardano, et al. Issued: Feb. 6, 1990

The relevant portions of the foregoing disclosures may be briefly summarized as follows:

U.S. Pat. No. 4,901,117 to Derrick, incorporated by reference into this application, discloses a sheet feeder having plural copy sheet trays for retaining sheets to be fed therefrom to a common path for transport to a transfer station of an electrophotographic printing machine. The sheet trays are arranged in a substantially horizontal plane with respect to each other.

U.S. Pat. No. 4,660,963 to Stemmle, incorporated by reference into this application, discloses a sheet feeder having plural copy sheet trays for retaining sheets to be fed therefrom to a common path for transport to a transfer station of an electrophotographic printing machine. As further disclosed within this reference, both trays from which copy sheets are fed, disposed in a substantially horizontal co-planar arrangement in a unitary drawer which can be slid away from the printing machine to load sheets, as desired. The device also includes a mechanical loading apparatus for one of the trays so that sheet previously imaged are returned for later duplex imaging.

U.S. Pat. No. 5,004,218 to Sardano discloses a retard type bottom sheet separator, in which the bottom of a stack of original document sheets is driven downstream to a separation nip with a retard pad by the planer upper flight of a driven frictional separator bottom feed belt. A shoe unit with a large planar overlying the belt assists feeding by applying a normal force on the sheets.

In accordance with one aspect of the present invention, there is provided an apparatus for feeding individual sheets while reducing the noise associated therewith. The apparatus comprises means for advancing and separating individual sheets in a first direction and means, adjacent the advancing and separating means, for dampening sheet flutter and reducing the noise associated therewith.

Pursuant to another aspect of the present invention, there is provided an electrophotographic printing machine of the type in which individual sheets are fed from a stack by a feeder having a device to reduce the noise associated therewith. The improvement comprises means for advancing and separating individual sheets in a first direction and means, adjacent the advancing and separating means, for dampening sheet flutter and reducing the noise associated therewith.

Pursuant still to another aspect of the present invention, there is provided a retard pad feeding apparatus for feeding sheets from a stack of sheets along a paper path. The feeding apparatus comprises a friction pad positioned along the path and a roller positioned proximate the pad so that a sheet feeding nip is formed between the pad and the roller, the roller adapted to urge individual sheets from the stack through the nip. A means for dampening sheet vibration positioned to contact a sheet exiting the nip while a portion of the sheet is in the nip is also provided.

In accordance with yet another aspect of the present invention, there is provided a method for reducing noise generated by feeding sheets by a retard pad feeding apparatus. The method comprises the steps of urging at least one sheet in a sheet feeding direction to a retard nip and transporting a sheet through the nip in the sheet feeding direction. The step of damping the vibrations induced in the transported sheet while in the nip so that audible noise generated by the transporting step is inhibited is also provided.

Other features of the present invention will become apparent as the following description proceeds and upon reference to the drawings, in which:

FIGS. 3A and 38 are enlarged elevational views illustrating the operation of a first embodiment of the present invention;

Figure 1:
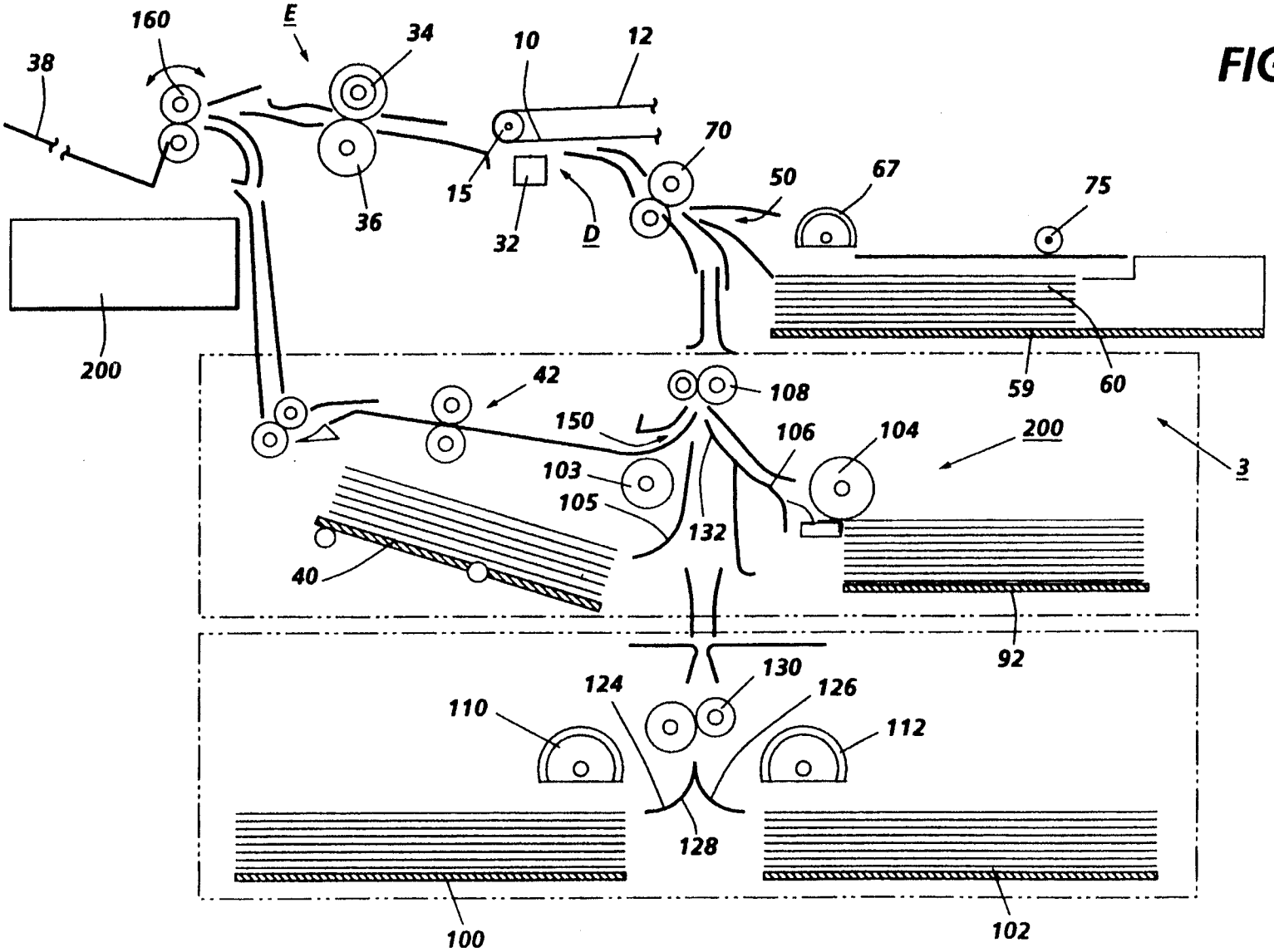
FIG. 1 is an enlarged elevational view of a sheet feeding system incorporating the features of the present invention therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims. For a general understanding of the features of the present invention, references should be made to the drawings. In the drawings, like numerals have been used to identify identical elements.

Figure 5:
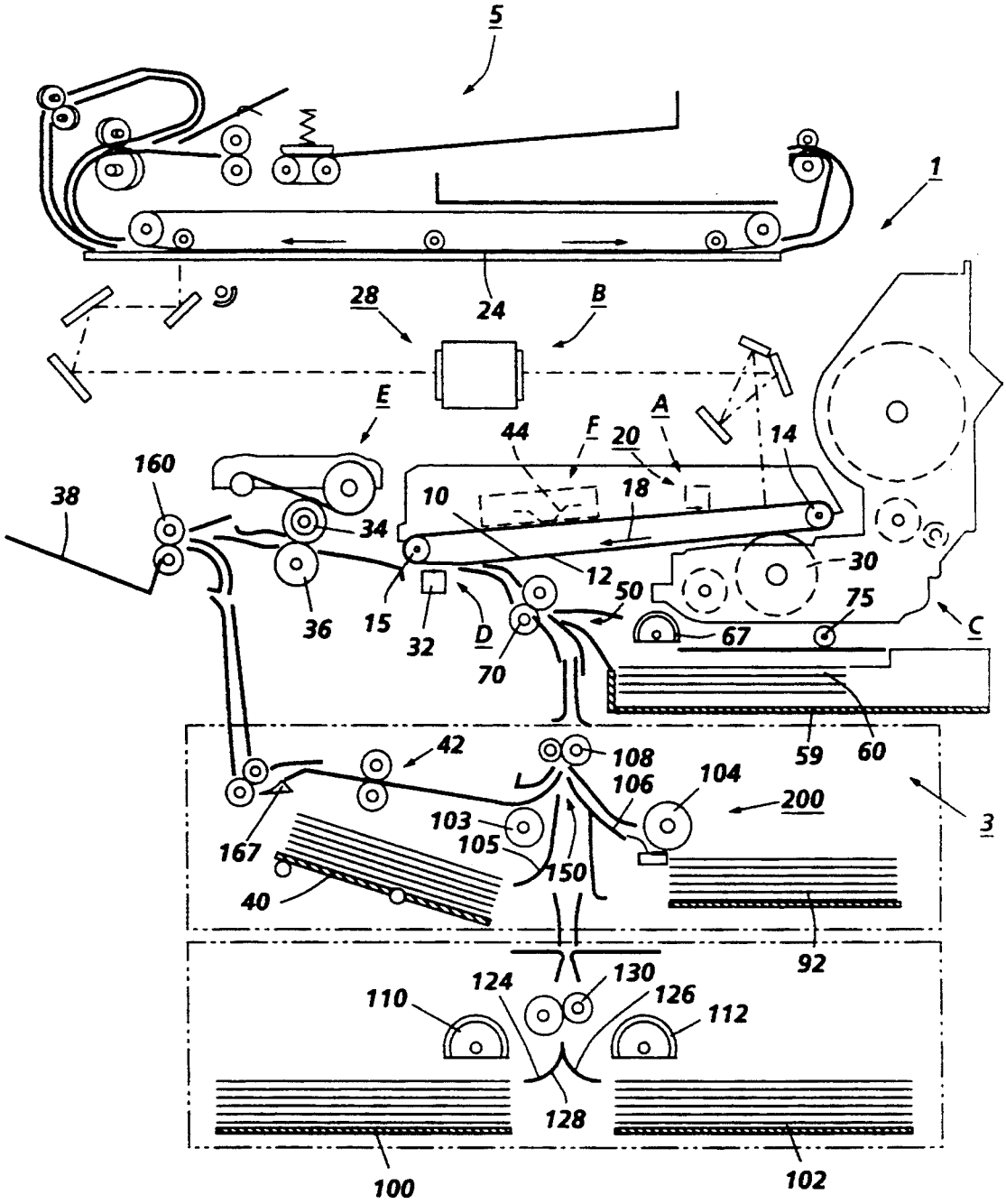
FIG. 5 is a schematic elevational view depicting an illustrative electrophotographic printing machine incorporating the sheet handler system of the present invention.

FIG. 5 schematically depicts an illustrative electrophotographic printing machine of the type in which the present invention may be employed. Specifically, the printing machine 1 of FIG. 5 has both a copy sheet handling system 3 and a document handling system 5 for transporting sheets of material such as paper, mylar and the like, to and from processing stations of the machine 1. The machine 1 has conventional imaging processing stations associated therewith, including a charging station A, an imaging/exposing station B, a development station C, a transfer station D, a fusing station E, and a cleaning station F. It will be understood that a conventional finishing station (not shown) could easily be included in the machine. The machine 1 has a photoconductive belt 10 with a photoconductive layer 12. The belt 10 is entrained about a drive roller 14 and a tension roller 15. The drive roller 14 functions to drive the belt in the direction indicated by arrow 18. The drive roller 14 is itself driven by a motor (not shown) by suitable means, such as a belt drive.

The photoconductive belt 10 is charged at the charging station A by a corona generating device 20. The charged portion of the belt is then transported to the imaging/exposing station B where a latent image is formed on the belt 10 corresponding to the image on a document positioned on a platen 24 via the light lens imaging system 28 of the imaging/exposing station B. Obviously, electronic imaging of page image information could be facilitated by a printing apparatus utilizing electrical imaging signals. The printing apparatus can be a digital copier including an input device such as a raster input scanner (RIS) and a printer output device such as a raster output scanner (ROS), or, a printer utilizing a printer output device such as a ROS.

Thereafter, portion of the belt 10 bearing the latent image is transported to development station C where the latent image is developed by electrically charged toner material from a magnetic developer roller 30 of the developer station C. The developed image on the belt is then transported to a transfer station D where the toner image is transferred to a copy sheet substrate transported in the copy handling system 3. In this case, a corona generating device 32 is provided to attract the toner image from the photoconductive belt 10 to the copy sheet substrate. The copy sheet substrate with image thereon is then directed to the fuser station E. The fuser at station E includes a heated fuser roll 34 and backup pressure roll 36. The heated fuser roll and pressure roll cooperate to fix the image to the substrate. The copy sheet then, as is well known, may be selectively transported to an output tray 38 or along a selectable duplex path including apparatus for buffered duplexing and for immediate duplexing (i.e., tray 40 and path 42 in the case of the illustrative printing machine of FIG. 3). The portion of the belt 10 which bore the developed image is then transported to the cleaning station F where residual toner and charge on the belt is removed in a conventional manner by a blade edge 44 and a discharge lamp (not shown). The cycle is then repeated.

The invention will now be discussed in greater detail with respect to FIG. 1 which represents a copy sheet feeding device or transport 3 constructed in accordance with the present invention. The transport in this embodiment is adapted for feeding sheets to image processing stations. In this embodiment, the sheets are fed to stations D and E of an illustrative electrophotographic printing machine (otherwise not shown). The station D is a transfer station having a belt 10 with a photoconductive surface 12 and corona generator device 32 positioned thereat. The exemplary fusing station E comprises a heated roll 34 engaged by a pressure roll 36 forming a sheet receiving nip. A motor (not shown) is suitably connected to actuate the rollers so that sheets in the nip are urged therethrough.

The copy sheet transport 3 depicted in FIG. 1 includes a sheet feeding means which includes a removable cartridge or cassette 59 in which sheets 60 may be positioned for feeding by a segmented roll 67 along a path 50 to registration rolls 70. The feeding means also includes a bypass feeding means which includes a driving roll 75 for transporting sheets under the segmented roll 67, in the position shown, to the path 50 and registration rolls 70.

The copy sheet transport 3 also includes a first sheet bin or tray 40 and a second sheet tray 92, incorporating the noise suppression device of the invention herein, on a substantially horizontal plane, a third sheet tray 100 and a fourth sheet tray 102, each, are positioned in substantially vertical planes with respect to the plane of the trays 40 and 92, and both trays 100 and 102 are positioned in substantially the same horizontal plane, Preferably, the trays 40 and 92 are supported in a slidable drawer mechanism, as are the trays 100 and 102.

Sheets positioned in each of the stacks may be selectively fed to the depicted stations D and E. Sheets from the stack disposed in tray 40 and 92 are fed by feed rolls 103 and 104, respectively. These feed rolls and the trays may be mounted in a suitable known manner, but it is preferred that they are mounted on a toggle carriage, substantially as described and disclosed in U.S. Pat. No. 4,660,963, incorporated herein by reference, to enable selective feeding from the trays 40 and 92. Sheets actuated by the feed roll 103 from tray 40 are urged along a concave baffled surface 105 for transport upwardly from the stack of sheets to take away rolls 108. Sheets from the stack of sheets in tray 92 are also urged along a baffle surface 106 to the take away rolls 108 by the feed roll 104, as will be discussed in further detail below.

Sheets from the stack of sheets in the tray 100 and sheets from the stack of sheets in tray 102 are actuated from their respective stacks in substantially the same manner by selectively actuable segmented feed rolls 110 and 112, respectively. The rollers 110 and 112, when feeding sheets from the respective stacks with which they are associated, are rotated into frictional engagement with the top sheet to urge the top sheet along one of concave surfaces 124 and 126 of double sided baffle 128 to the lower take away rolls 130. The lower take away rolls 130 urge sheets therein upwardly to the take away rolls 108 through an aperture 132 found between the baffle surface 105 and the baffle surface 106. Sheets engaged by the take away rolls 108 are in a common transport path 150 for transport to the process stations D and E.

Specifically, sheets selectively fed from the trays 40, 92, 100, and 102 enter a common path 150 commencing just prior to take away rolls 108. These sheets are urged along the common path 150 by the take away rolls 108 to registration rolls 70 to promote registered transport of the sheets through the transfer station D and to urge the sheets through the station D and to the fusing station E. The fuser station E, comprising heating roll 34 and pressure roll 36 are actuated so that toner images on sheets passing therethrough are fixed to the sheets and the sheets are also urged to reversible rolls 160. The reversible rolls 160 initially are rotated to urge a sheet partly into output tray 38. The action of the rolls 160 may continue so as to deposit the sheet in the tray 38 or may be reversed to drive a sheet therein along a return path 162, which includes driving rolls 164 and a gate 167. The gate is selectable positionable to direct sheets along immediate or trayless duplexing path 42 for return to the common path 150 or into tray 40 for selective return to the common path.

Figure 2:
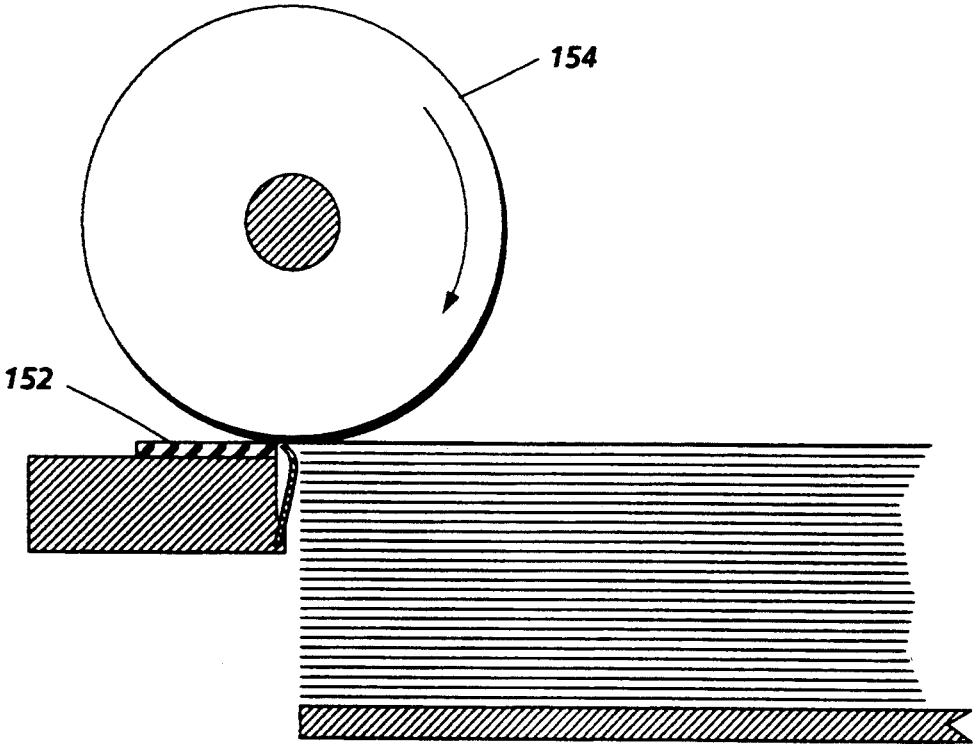
PRIOR ART FIG. 2
FIG. 2 is an enlarged elevational view of a prior art retard feeder.

Sheets are fed from the stack in tray 92 by actuation of the roller 104 to a feeding position where the roller frictionally engages the surface of a sheet in the tray to urge it toward a retard pad 172 on the baffle surface 106 which forms a nip with the roller 104. A known retard pad feeding configuration is illustrated in FIG. 2. As is well known, the urging of the sheet toward the retard nip also causes other sheets in the stack to move toward the nip. The retard pad 152 is formed of a material which exerts a frictional force on the sheets greater than the frictional force between the sheets so that the lower sheets tend to slip as the upper sheet to be fed moves through the nip by roller 154. Thus, feeding of single sheets as desired is enabled.

Figure 3A:
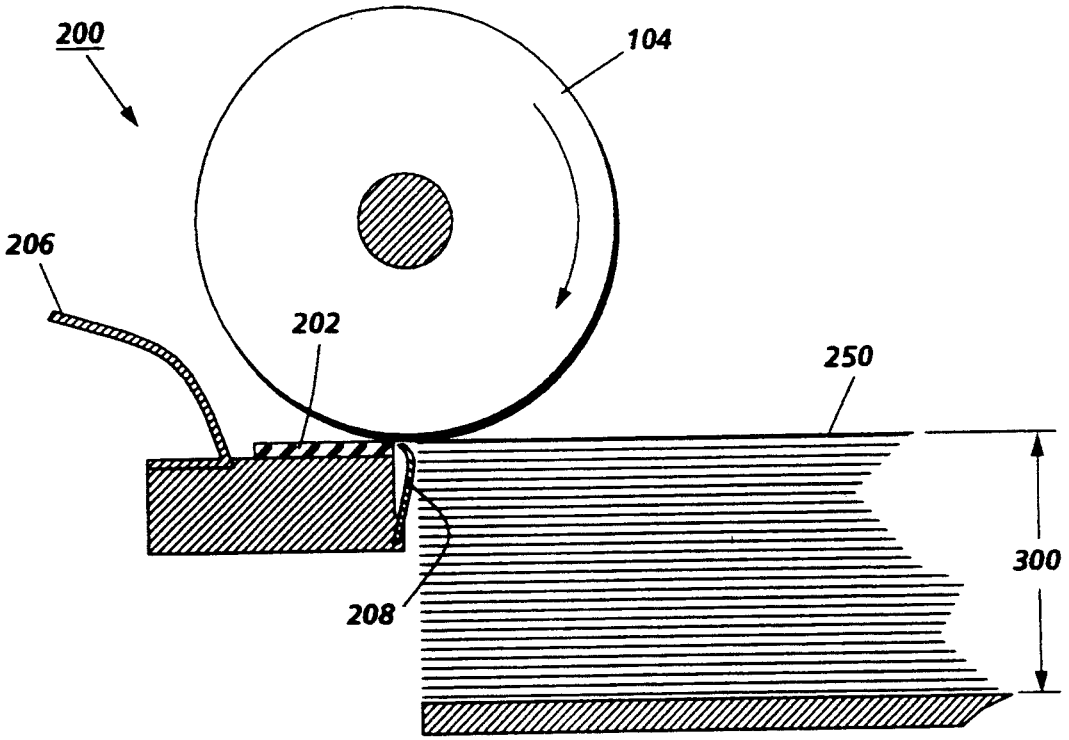
Figure 3B:
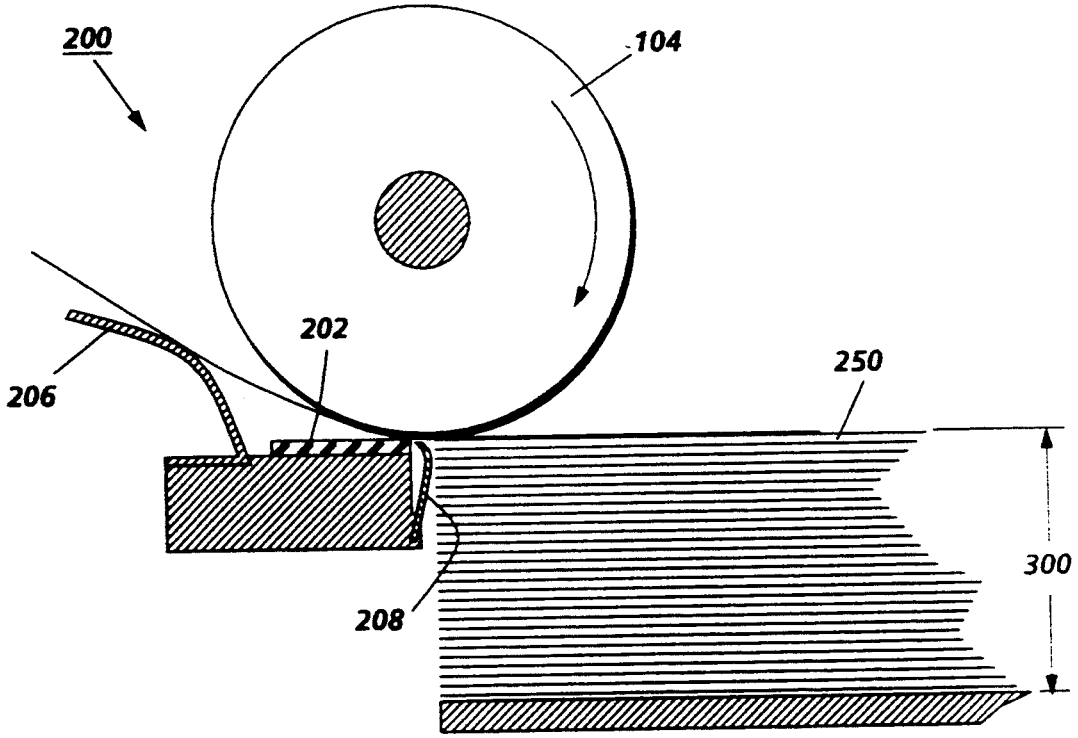

Turning now to FIGS. 3A and 3B, the operation of the retard feeder with the noise suppression device of the present invention will be discussed. The retard feeder 200 consists of a feed roll 104, a retard pad 202, and a flexible resilient strip 206 located downstream of the retard nip. As a sheet 250 is frictionally contacted by the feed roll 204 and fed from the top of the sheet stack 300, the sheet is caused to enter the retard nip by the nip guide 208. As a result of the coefficient of friction being greater between the retard pad and a sheet and the feed roll and a sheet, should a double sheet enter the retard nip, the lower sheet is held back by the frictional force of the retard pad while the upper sheet is singularly fed through the nip and into the paper path. The lead edge of sheet 250 then contacts the flexible resilient strip 206 while still within the retard nip. This flexible strip 206 causes a corrugation of the sheet parallel to the direction of travel thereby increasing the beam strength of the sheet 250. The strip tends to raise the portion of the sheet 250 engaged as the remaining portions of the sheet are urged through the retard nip by the roller 104. This corrugation of the sheet helps to minimize the sheet flutter and vibration while it is within the retard nip and thereby decreases the audible noise created by the vibrating sheet 250. As discussed previously, the sheet is then forwarded through the baffle 106 (FIG. 1) to the take-away rolls 108 (FIG. 1).

Figure 4:
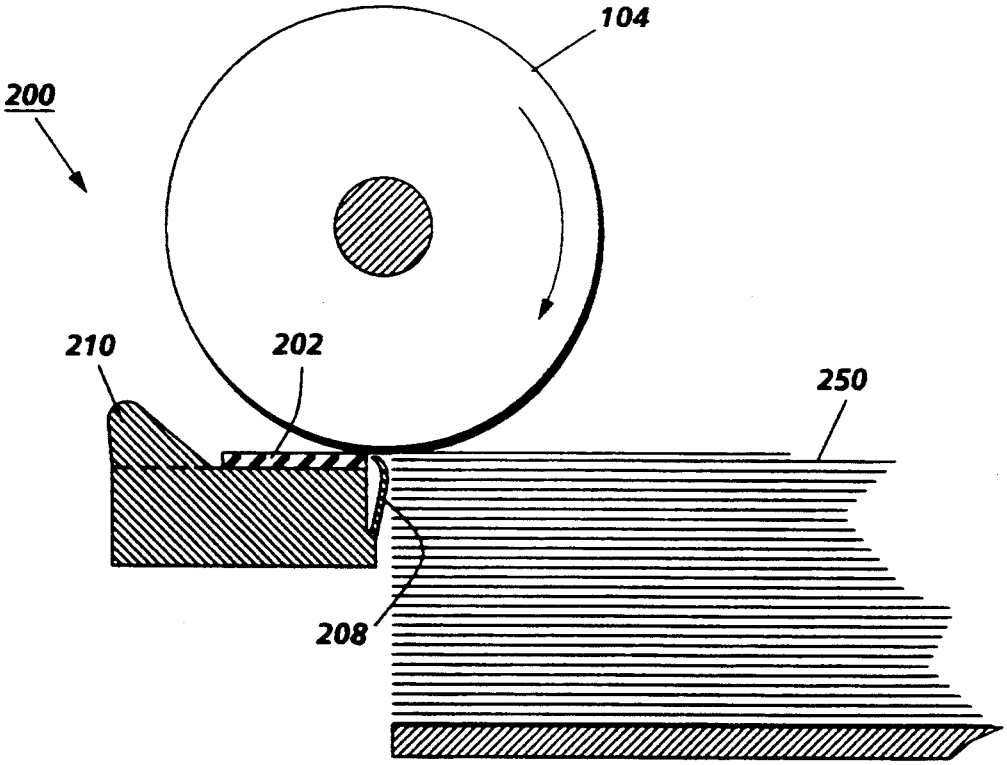
FIG. 4 is an enlarged elevational view showing of a second embodiment of the present invention.

Turning now to FIG. 4, a second embodiment of the retard feeder with the noise suppression device of the present invention is illustrated. The feeder 200 consists again of a feed roll 104, a retard pad 202 and has a ramped section 210 built into the retard pad downstream of the retard nip. Again, the top sheet 250 is fed as in the previous instance and is separated to a single sheet by the retard nip. The ramped section 210 acts to corrugate the sheet in the same manner as the flexible strip 206 of the previous embodiment. This corrugation again increases the sheet beam strength and reduces the audible noise created by the sheet feeder.

In recapitulation, a sheet feeding system which feeds sheets from a stack of sheets to a sheet transport path has been described. Specifically, the device includes a sheet feeding friction device for engaging and moving sheets in a direction toward the path, a retard pad positioned adjacent said sheet feeding device to form a retard nip to permit selective feeding of individual sheets through the retard nip to the path, and a raised portion in the path for corrugating the sheet as portions of the sheet are engaged in the retard nip. This corrugation increases the beam strength of the sheet and reduces the sheet flutter and vibration which results in a reduction of the audible noise associated therewith.

It is, therefore, apparent that there has been provided in accordance with the present invention, a sheet handler that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for feeding individual sheets while reducing the noise associated therewith, comprising:
   a frictional retard pad feeder to advance sheets in a first direction; and
   a raised member for corrugating the individual sheets in a direction parallel to the sheet direction, located downstream of said retard pad feeder in the first direction, said raised member being adapted to reduce sheet flutter and the noise associated therewith, wherein said raised member comprises a ramped section integral to said retard pad feeder, said ramped section being formed of a material having a low coefficient of friction.

2. An apparatus for feeding individual sheets while reducing the noise associated therewith, comprising:
   a frictional retard pad feeder to advance sheets in a first direction; and
   a raised member for corrugating the individual sheets in a direction parallel to the sheet direction, located downstream of said retard pad feeder in the first direction, said raised member being adapted to reduce sheet flutter and the noise associated therewith, wherein said raised member comprises a flexible strip secured at one end to said retard pad and extending away from said retard pad in the direction of sheet travel, said strip further having a low coefficient of friction.

3. An electrophotographic printing machine of the type in which individual sheets are fed from a stack by a feeder having a device to reduce the noise associated therewith, comprising:
   a frictional retard pad feeder to advance sheets in a first direction; and
   a raised member for corrugating the individual sheets in a direction parallel to the sheet direction, located downstream of said retard pad feeder in the first direction, said raised member being adapted to reduce sheet flutter and the noise associated therewith, wherein said raised member comprises a ramped section integral to said retard pad feeder, said ramped section being formed of a material having a low coefficient of friction.

4. An electrophotographic printing machine of the type in which individual sheets are fed from a stack by a feeder having a device to reduce the noise associated therewith, comprising:
   a frictional retard pad feeder to advance sheets in a first direction; and
   a raised member for corrugating the individual sheets in a direction parallel to the sheet direction, located downstream of said retard pad feeder in the first direction, said raised member being adapted to reduce sheet flutter and the noise associated therewith, wherein said raised member comprises a flexible strip secured at one end to said retard pad and extending away from said retard pad in the direction of sheet travel, said strip further having a low coefficient of friction.

5. A method for reducing noise generated by feeding sheets by a retard pad feeding apparatus, said method comprising the steps of:
   urging at least one sheet in a sheet feeding direction to a retard nip;
   transporting a sheet through the nip in the sheet feeding direction; and
   damping vibrations induced in the transported sheet while in the nip; wherein the step of damping includes corrugating the sheet during the transporting step to reduce the vibrations induced in the transported sheet while in the nip so that audible noise generated by said transporting step is inhibited.

6. The method of claim 5, wherein said dampening step includes corrugating the leading portion of the transported sheet downstream of the nip while trailing portions of the transported sheet are in the nip.

7. An apparatus according to claim 1, wherein said retard feeder comprises:
   a friction pad positioned along the path;
   a roller positioned proximate the pad so that a sheet feeding nip is formed between said pad and said roller, said roller adapted to urge individual sheets from the stack through the nip.

8. The apparatus of claim 7, further comprising a feed roller assembly for supporting said feed roller for movement between a first active position wherein said nip is formed and a second position away from said pad.

9. The apparatus of claim 8, further comprising a sheet guide positioned proximate the nip formed by said pad and said roller in said first active position for guiding sheets, urged by said roller in said first direction, to the nip.

10. An apparatus according to claim 3, wherein said retard feeder comprises:
   a friction pad positioned along the path;
   a roller positioned proximate the pad so that a sheet feeding nip is formed between said pad and said roller, said roller adapted to urge individual sheets from the stack through the nip.

11. The apparatus of claim 10, further comprising a feed roller assembly for supporting said feed roller for movement between a first active position wherein said nip is formed and a second position away from said pad.

12. The apparatus of claim 11, further comprising a sheet guide positioned proximate the nip formed by said pad and said roller in said first active position for guiding sheets, urged by said roller in said first direction, to the nip.

* * * * *